US006343916B1

(12) United States Patent
Bougamont et al.

(10) Patent No.: US 6,343,916 B1
(45) Date of Patent: Feb. 5, 2002

(54) PUMP BODY AND METHOD FOR MAKING SAME

(75) Inventors: Jean-Louis Bougamont; Pierre Dumont, both of Eu; Hervé Lompech, Incheville, all of (FR)

(73) Assignee: Rexam Sofab (FR)

( * ) Notice: Subject to any disclaimer, the term of this patent is extended or adjusted under 35 U.S.C. 154(b) by 0 days.

(21) Appl. No.: 09/463,400

(22) PCT Filed: Jul. 30, 1998

(86) PCT No.: PCT/FR98/01691

§ 371 Date: Apr. 10, 2000

§ 102(e) Date: Apr. 10, 2000

(87) PCT Pub. No.: WO99/06701

PCT Pub. Date: Feb. 11, 1999

(30) Foreign Application Priority Data

Aug. 1, 1997 (FR) ..... 97 09861

(51) Int. Cl.[7] ..... F04B 39/10

(52) U.S. Cl. ..... 417/569; 29/888.073

(58) Field of Search ..... 417/569; 222/321.7, 222/321.9, 380; 137/533.11

(56) References Cited

U.S. PATENT DOCUMENTS 3,044,413 A * 7/1962 Corsette ..... 417/569
4,197,875 A * 4/1980 Schieferstein et al. . 137/533.11
6,045,008 A * 4/2000 González et al. .... 222/321.9 X
6,196,424 B1 * 3/2001 Bougamont et al. ..... 222/321.9

FOREIGN PATENT DOCUMENTS

JP 2826847 * 11/1998

* cited by examiner

*Primary Examiner*—Charles G. Freay
*Assistant Examiner*—W Rodriguez
(74) *Attorney, Agent, or Firm*—Bacon & Thomas PLLC

(57) ABSTRACT

A pump of the type comprising a substantially cylindrical body (1) in one piece provided, in its lower part, with a port (11) for admission of a product and with a valve constituted by a cavity (10) containing an element (2) capable of moving between a lower stop (12*b*) corresponding to the obturation of said admission port (11) and an upper stop (12*a*) corresponding to the opening of said port (11), and wherein said upper stop (12*a*) is formed by at least one discontinuous internal projection (12) whose transverse dimension (x) measured in the cavity (10) is at least equal to 20% of the largest transverse dimension of the mobile element (2).

12 Claims, 4 Drawing Sheets

PUMP BODY AND METHOD FOR MAKING SAME

BACKGROUND OF THE INVENTION

1. Field of the Invention

The present invention relates to a pump and more particularly to an improvement in the inlet valve of the pump as well as to a process for manufacturing such a pump.

2. Related Art

The invention concerns pumps of the type comprising in particular a substantially cylindrical body in one-piece, provided in its lower part with a port for admission of the product and with a valve. This valve is constituted in known manner by a cavity forming seat and containing an element capable of moving between a lower stop corresponding to a position of obturation of the admission port and an upper stop corresponding to the opening of said port and to the filling of the pump body by the product.

The stroke of the mobile element which is generally constituted by a ball, must be adjusted so as to obtain the regular delivery by the pump of identical, constant doses.

Consequently, the upper and lower stops must be positioned with precision.

According to a known solution, the upper stop is constituted by the lower turn of a helicoidal return spring housed in the pump body.

However, this spring creates problems of bulk and/or of compatibility with the product.

A variant embodiment of this upper stop consists in fixing an added piece in the lower part of the pump body above the mobile element.

However, the production of this piece and its assembly in the pump are complex and expensive operations.

In addition, it is necessary to arrange on the pump body specific means for fixing this piece.

Another solution lies in the presence of retaining bosses moulded directly in the pump body like in U.S. Pat. No. 2,294,568.

These bosses project inside the pump body and define towards the top the cavity in which the mobile element is housed.

However, the transverse dimension of these bosses measured from the inner wall of the body always remains small with respect to the inner diameter of the cavity in order to allow unmoulding of the body and the subsequent introduction of the mobile element in the cavity. For the same reasons, the section of these retaining bosses comprises neither angular zone nor free edge in undercut. Nonetheless, despite this, the projecting bosses are sometimes crushed upon ejection from the mould, which considerably compromises the subsequent reliability of the pump insofar as the mobile element can then escape from its cavity.

In the Patent Abstracts of Japan Vol. 15 No. 392 of Oct. 4, 1991 and JP-A-316 1066, the upper stop of the mobile element of the valve is ensured by means of discontinuous internal projections performed by cut-out using a tool incorporating a blade whose profile is bevelled.

Moreover, the non-aggressive profile of these projections promotes the jamming of the mobile element in the top of the cavity, which increases the risks of dysfunction of the pump.

All these problems are even more substantial when the pump is a miniature pump, intended for example for samples of perfume or dispensers of small doses of medicaments.

It is an object of the present invention satisfactorily to solve the technical problems raised by the prior art.

BRIEF SUMMARY

This object is attained in accordance with the invention by a pump of the type comprising in particular a substantially cylindrical body in one piece provided, in its lower part, with a port for admission of the product and with a valve constituted by a cavity containing an element capable of moving between a lower stop corresponding to the obturation of said admission port and an upper stop corresponding to the opening of said port, wherein said upper stop is formed by at least one discontinuous internal projection whose transverse dimension measured in the cavity is at least equal to 20% of the largest transverse dimension of the mobile element.

According to an advantageous characteristic, said projection has an inner edge of which the generatrices are substantially parallel to the axis of the body.

Diameter is included between 50% and 90% of the largest transverse dimension of the mobile element.

According to other characteristics, the upper face of said projection is wider than its lower face.

Said projection preferably presents, outside said cavity, an at least partly cylindrical cut out of which the generatrices are parallel to the axis of the body.

According to a particular embodiment, the upper stop comprises four projections diametrally opposite in two's.

These four projections are preferably separated by free sectors capable of allowing the product to pass.

According to a specific variant, the free sectors have an angular length included between 30° and 80°.

Another object of the invention is a process for manufacturing a pump, characterized in that the pump body is produced, then at least one discontinuous internal projection is formed by fashioning the inner wall of said body by means of a punching die, of which the diameter of the head is included between 110% and 140% of the largest transverse dimensions of the mobile element.

The transverse dimension of the internal projection, the diameter of the upper orifice of the cavity as well as the diameter of the head of the punching die are parameters which are chosen with reference to the largest transverse dimension of the mobile element but which also depend on the depth of penetration of the punching die in the wall of the body of the pump. This depth is limited by the available wall thickness in the zone intended for fashioning and, for determining the values of the above parameters, was fixed at 25% of the wall thickness of the pump body.

According to an advantageous characteristic, said body is fashioned internally by the punching die pushing the matter constituting the wall downwardly and inwardly, so as partly to close the cavity.

According to another characteristic, said body is fashioned internally with a punching die incorporating four blades diametrally opposite in two's.

According to yet another characteristic of the process, the mobile element is introduced in the lower part of the body, prior to the formation of said internal projection.

The pump of the invention thus comprises a particularly reliable and precise inlet valve. With such a valve, the risks of the mobile element jamming or escaping are virtually non-existent.

In addition, the process of the invention makes it possible to produce projections whose transverse dimension is so large that they could not be made by moulding and which, moreover, would not allow the subsequent positioning of the mobile element.

The process of the invention also enables projections of various dimensions to be made on the same type of pump body, which allows mobile elements of different sizes to be used.

DESCRIPTION OF THE DRAWINGS

The invention will be more readily understood on reading the following description with reference to the accompanying drawings, in which.

DETAILED DESCRIPTION

Figure 1:
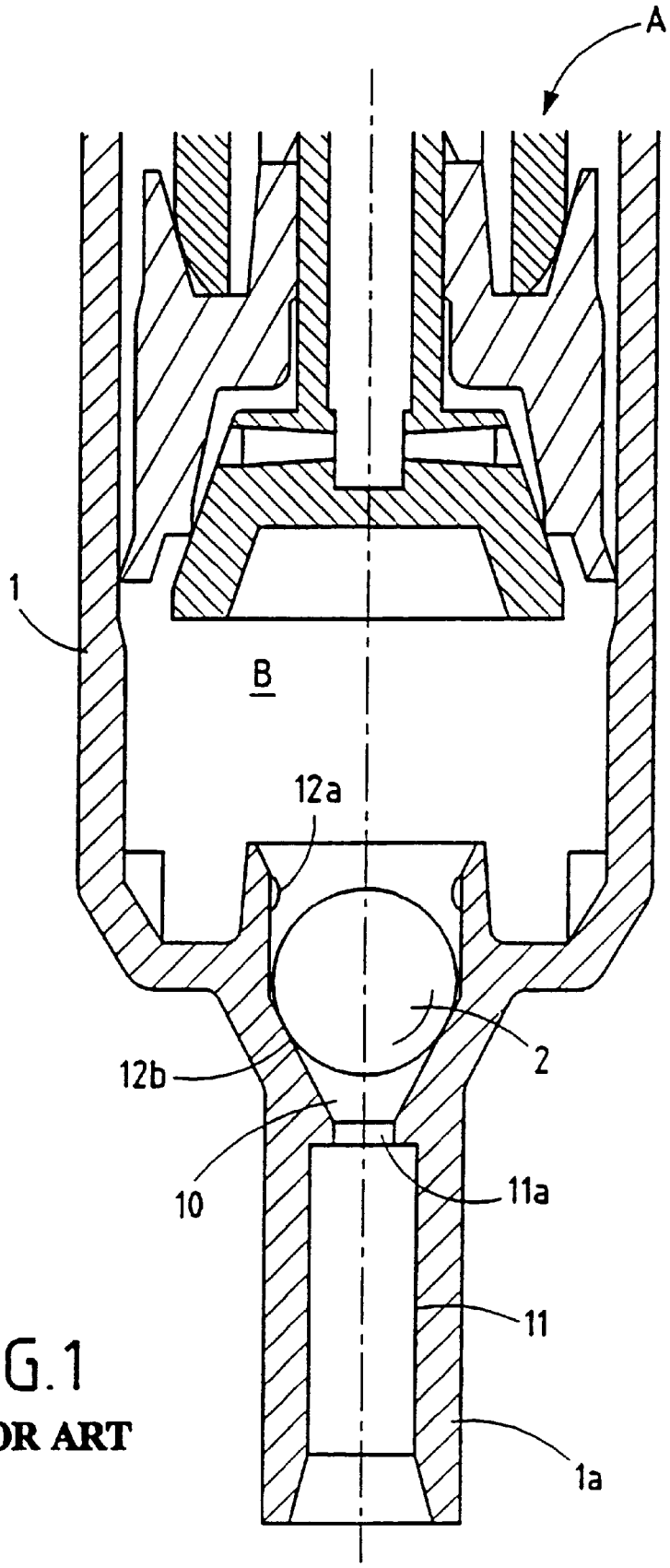
FIG.1 PRIOR ART
FIG. 1 shows a view in section of a pump body according to the prior art.

The body 1 shown in FIG. 1 corresponds to that of a conventional pump A used, for example, for sprays of liquids such as perfumes.

The body 1 is substantially cylindrical and is made in one piece, for example by injection moulding of a thermoplastics material.

The body is provided in its lower part 1*a* with an admission port 11 supplied with product from a tank (not shown) and possibly extended downwardly by an immersion tube.

The admission port 11 opens out via an orifice 11*a* on a valve constituted by a cavity 10 containing a mobile element such as a ball 2.

The ball 2 is capable of moving axially between a lower stop 12*b* corresponding to the obturation of the port 11 and therefore to the closure of the valve, and an upper stop 12*a* corresponding to the opening of said valve and to the passage of the product towards chamber B of pump A.

The lower stop 12*b* is formed by the truncated wall of the cavity 10 against which the ball 2 comes into tight stop.

The upper stop 12*a* is here formed by retaining elements made directly by moulding with the pump body assembly, in the tipper part of the cavity 10.

These retaining elements are bosses which offer the ball 2 slightly projecting curvilinear contact surfaces, i.e. each boss has a transverse dimension of at the most 20% of the radius R of the ball 2, which is insufficient to guarantee perfect functioning of the valve.

Between these bosses are arranged lateral passages for the product.

Figure 2A:
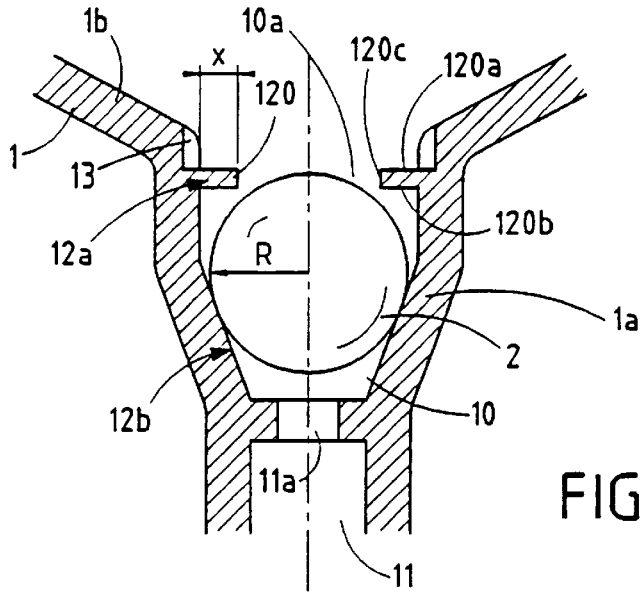
FIGS. 2*a* and 2*b* show detailed views in section of an embodiment of a pump body according to the invention, respectively in position of closure of the valve and in position of opening thereof.
Figure 2B:
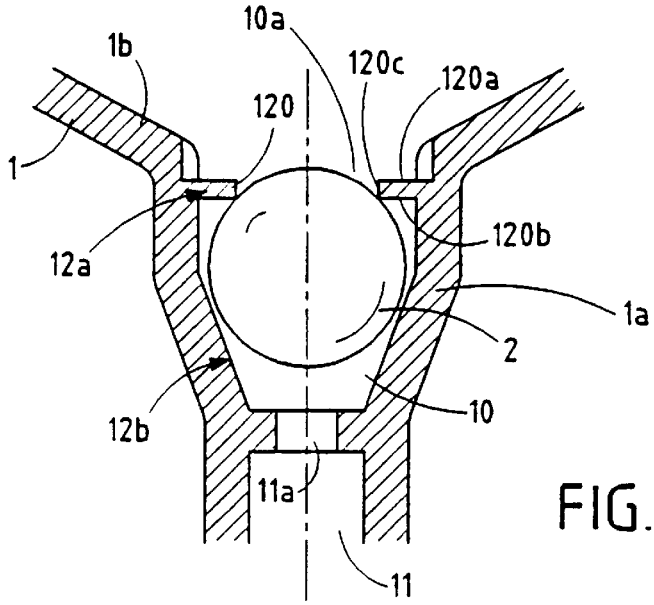

FIGS. 2*a* and 2*b* represent partial views in section of an embodiment of the body 1 of a pump according to the invention, respectively in position of closure and of opening of the valve.

Here, the upper stop 12*a* is formed by at least one internal projection 120 made on the upper periphery of the cavity 10 and discontinuously, forming at least one lateral passage for the product around the ball 2.

The transverse dimension X of the projection 12*a* measured in the conico-cylindrical cavity 10 is at least equal to 20% of the largest transverse dimension of the mobile element and therefore of the diameter of the ball 2 or to 40% of its radius R.

The cavity 10 is therefore defined and partly closed in its upper part by a transverse wall portion whose total length corresponds to twice the transverse dimension X, viz. at least 40% of the diameter of the ball 2 (or to 80% of the radius R), which guarantees a blockage of the ball in translation without jamming.

The upper orifice 10*a* of the cavity 10 is therefore relatively narrow and its diameter is included between 50% and 90% of the largest transverse dimension of the mobile element which corresponds here to the diameter of the ball 2.

The projection 120 presents an inner edge 120*c* of which the generatrices are substantially parallel to the axis of the body 1.

The projection 120 presents, outside the cavity 10, an at least partly cylindrical cut-out 13 of which the generatrices are substantially parallel to the axis of the body 1.

The upper face 120*a* of the projection 120 which faces the outside of the cavity 10 is wider than the lower face 120*b* which, for reasons of simplification, is shown here to be parallel to the upper face 120*a* and perpendicular to the inner wall of the cavity 10 in its upper part.

In accordance with a variant embodiment (not shown), the lower face 120*b* of the projection 120 is inclined, curvilinear or constituted by a swell but in no case does it present a zone of contact with the ball 2 in upper stop position in order to avoid any guiding or slide of the ball out of the cavity 10.

In the position of opening of the valve, shown in FIG. 2*b*, the ball is blocked in translation by the upper stop 12*a*, by coming into abutment against the join between the inner edge 120*c* and the lower face 120*b* of the projection 120.

Consequently, the zone of contact between the projection 120 and the ball 2 is materialized by a substantially circular line on which the forces of stop are directed radially with respect to the ball so as to avoid any jamming.

Figure 3A:
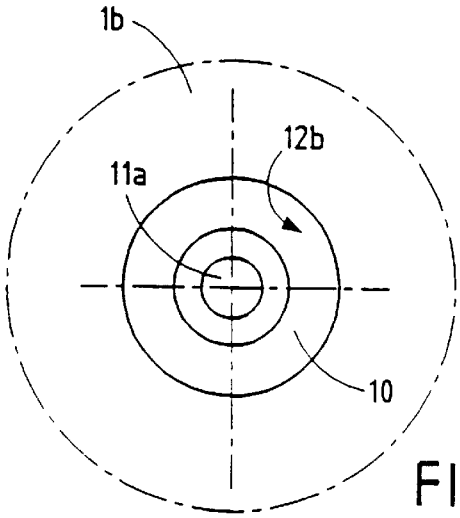
FIGS. 3*a* and 3*b* show partial plan views of the pump body respectively before and after fashioning.
Figure 3B:
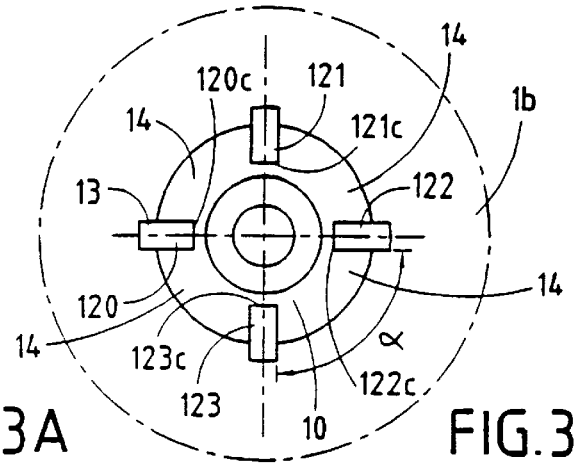

FIGS. 3*a* and 3*b* correspond to an embodiment with four projections 120, 121, 122, 123, diametrally opposite in two's, on the upper periphery of the cavity 10. The ball 2 has not been shown in these Figures.

The cut-outs 12 are interrupted at the level of the discontinuities of the projections 120, 121, 122, 123 to define free sectors 14.

On the sectors 14, the profile of the inner wall of the pump body has not been modified and is therefore smooth and continuous, so as to present no obstacle from the inside to the outside of the cavity 10 in order to allow free passage of the product.

Projections 120, 121, 122, 123 are here centred, on either side, on two perpendicular diameters.

Their respective inner edges 120*c*, 121*c*, 122*c*, 123*c* present a length such that the intermediate free sectors 14 correspond to portions of angles $\alpha$ included between 30° and 80°.

The pump A of the invention, and in particular the body 1 of said pump is made in conventional manner, for example, by injection moulding of plastics or thermoplastics material.

By fashioning the inner wall of the body 1, at least one discontinuous inner projection 120 is made, and preferably four projections separated by free sectors, by fashioning the inner wall of the body 1.

The ball 2 is preferably introduced in the lower part 1*a* of the body 1 prior to fashioning, when the inner wall is still uniform.

However, if the inner projection 120 is elastically deformable and/or flexible, it is then possible to proceed with introducing the ball after fashioning, by deforming stop on said projection.

Figure 4A:
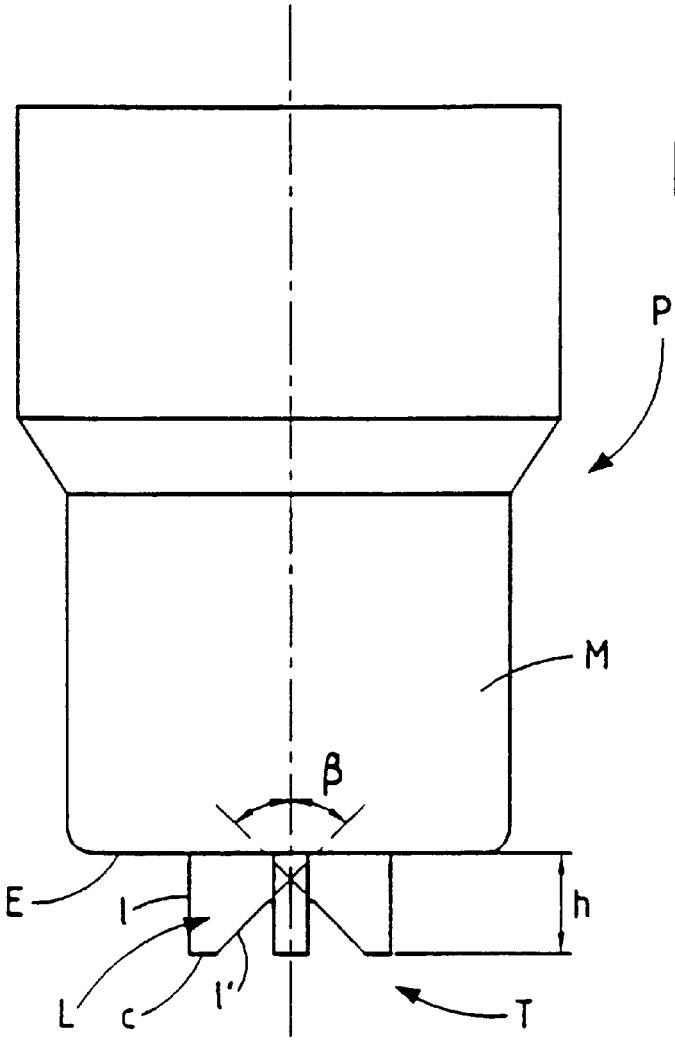
FIG. 4*a* shows a view in profile of a punching die used by the process of the invention.
Figure 4B:
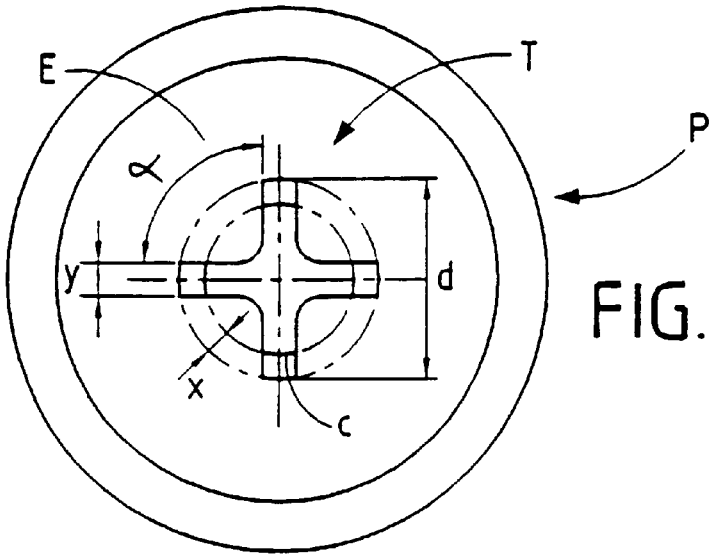
FIG. 4*b* shows a view from underneath of the punching die of FIG. 4*a*.

This fashioning or stamping operation is effected by means of a punching die P such as the one shown in FIGS. 4*a* and 4*b*.

The punching die P comprises a mandrel M bearing a head T. The mandrel M ensures centering, guiding and wedging of the punch in the pump body during fashioning.

Figure 5:
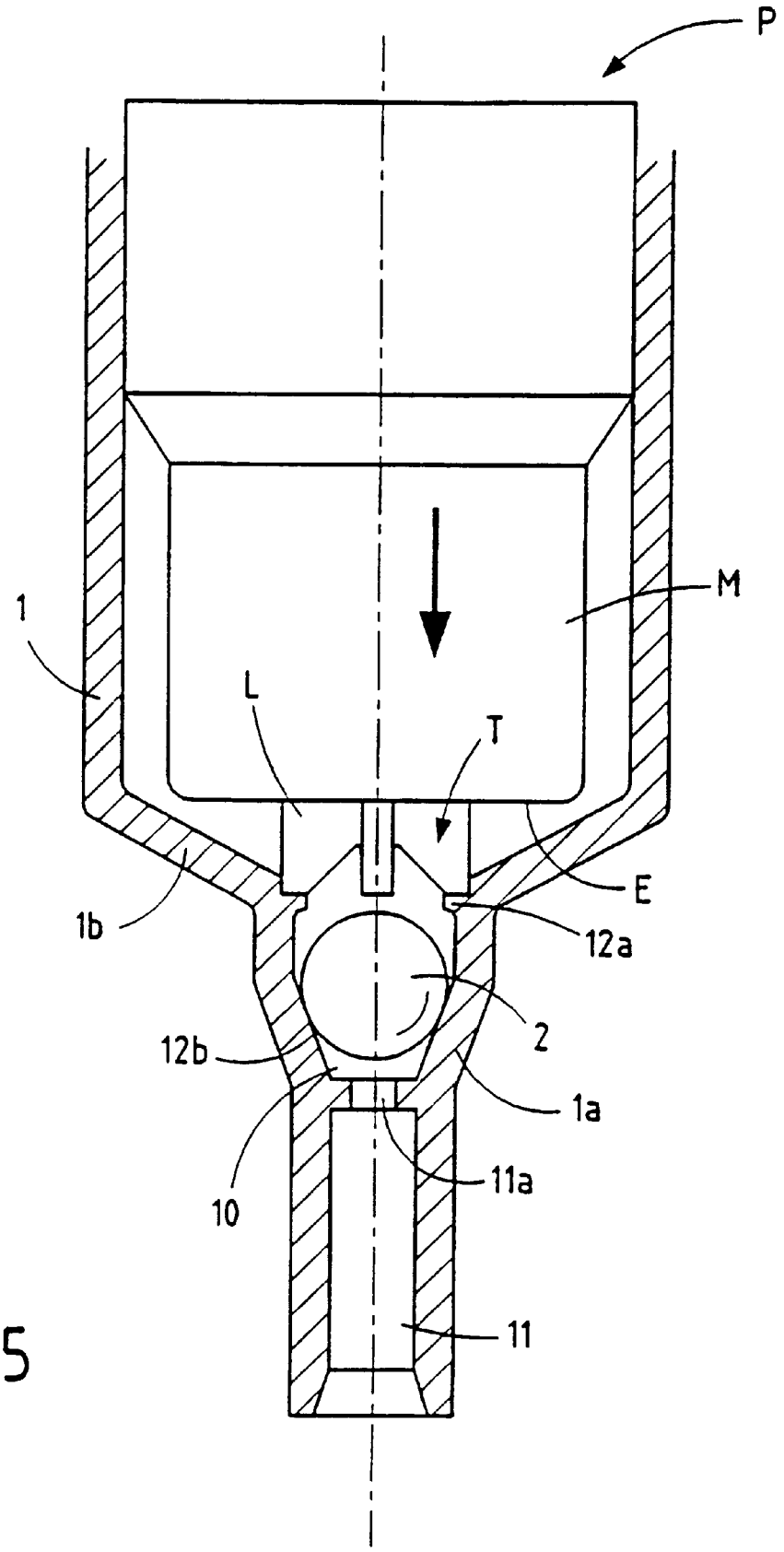
FIG. 5 shows a view in section of the pump body while the process of the invention is being carried out.

The head T ensures fashioning of the body by forced, axial translation of the mandrel M as shown in FIG. 5.

To that end, the head T comprises at least one and, in the present case, four blades L intended to push the matter on the wall of the body 1 above and around the ball 2, forming cut-outs 13, and the projections 120, 121, 122, 123 as shown in FIG. 5.

The diameter d of the head is included between 110% and 140% of the diameter of the ball for a depth of penetration of about 25% of the thickness of the wall of the body.

The geometry of the blades L shown from underneath in FIG. 4*b*, determines the subsequent geometry of the cut-outs 13, the projections 120, 121, 122, 123 and the free sectors 14.

The lower face C of blades L acts by its outer edge in the manner of a knife or a tooth with respect to the plastics material, causing it to creep towards the interior of the head.

The width and length of the lower face C is previously determined as a function of the dimensions sought for the projections.

The transverse dimension X of the projections to be made will depend on the volume of matter pushed downwardly and inwardly by each of the blades L on the inner periphery of the cavity 10. This volume therefore corresponds to the volume defined by the cut-outs 13. Now, this volume is itself a function of the diameter of the head T, of the width x of the lower face C and of the depth of penetration, of the angular length y and of the height h of the blades L.

The outer face 1 of the blades L is straight and parallel to the axis of the mandrel M while their inner face 1' is inclined towards the mandrel M and towards the centre of the head T by an angle β close to 45° in order not to stress the ball while the head is working.

The mandrel M comprises a face E intended to abut against a shoulder 1*b* of the pump body (cf. FIGS. 2*a* and 2*b*) in order to limit penetration of the head T.

Consequently, the position of the upper stop 12*a*, and therefore the stroke of the ball 2, will be determined as a function of the height h of the blades L with respect to face E of the mandrel.

What is claimed is:

1. A pump of the type comprising a substantially cylindrical body (1) in one piece provided, in its lower part, with a port (11) for admission of the product and with a valve constituted by a cavity (10) containing an element (2) capable of moving between a lower stop position (12*b*) corresponding to the obturation of said admission port (11) and an upper stop position (12*a*) corresponding to the opening of said port (11) and that is defined by at least one discontinuous internal projection (120) whose lowerface (120*b*) partly closes said cavity and whose upperface (120*a*) is topped, outside said cavity, with an at least partly cylindrical cut-out (13) whose generatrices are parallel to the axis of the body (1), and wherein said projection (120) defines an inner edge (120*c*) the generatrices of which are substantially parallel to the axis of the body (1) and which defines, at the junction of the lower face (120*b*)with the mobile element (2) a line contact in the upper stop position enabling avoidance of any jamming or sliding of said element outside the cavity (10).

2. The pump according to claim 1, wherein said mobile element is a ball housed in a conico-cylindrical cavity (10) which, in the upper stop position, abuts radially against a circular line contact defined by said projection (120).

3. The pump according to claim 1, wherein said cavity (10) defines an upper orifice (10*a*) laterally defined by the internal projection (12) and of which the inner diameter is included between 50% and 90% of the largest transverse dimension of the mobile element (2).

4. The pump according to claim 1, wherein the surface of the upper face (120*a*) of said projection (120) is wider than the surface of the lower face (120*b*).

5. The pump according to claim 1, wherein the upper stop (12*a*) comprises four projections (120, 121, 122, 123) diametrically opposed in pairs.

6. The pump according to claim 5, wherein the four projections are separated by free sectors (14) capable of allowing a product to pass.

7. The pump according to claim 5, wherein the free sectors (14) present an angular length included between 30° and 80°.

8. A process for manufacturing a pump as defined in claim 1, comprising the steps of producing the pump body (1) with at least said one discontinuous internal projection (120) formed on the inner wall of said body by using a punching die (P), wherein said projection (120) is formed by said die with an inner edge (120*c*) the generatrices of which are parallel to the axis of said body and which inner edge defines at the junction of the lower face (120*b*) a circular contact line with the mobile element (2) in the upper stop position.

9. The process according to claim 8, wherein said body is internally formed by the punching die (P) by pushing the material constituting the wall downwardly and inwardly so as to partly close the cavity (10).

10. The process according to claim 8, wherein said body (1) is internally formed by using said punching die (P) incorporating four blades (L) diametrally opposite in pairs.

11. The process according to claim 8, including introducing the mobile element (2) in the lower part of the body (1) prior to the step of forming of said internal projection (120).

12. The pump according to claim 1, wherein said projection includes a lower face (120*b*) extending perpendicular to the axis of the body (1).

* * * * *